United States Patent [19]

Iwaki et al.

[11] 4,230,058

[45] Oct. 28, 1980

[54] METHOD AND APPARATUS FOR MANUFACTURING BOX-SHAPED STRUCTURE FROM METAL SHEET

[75] Inventors: Takashi Iwaki; Takeji Tanaka; Yoshitomo Tanaka; Hiroshi Tanaka, all of Kisarazu, Japan

[73] Assignee: Yuwa-Sangyo Kabushiki-Kaisha, Tokyo, Japan

[21] Appl. No.: 13,737

[22] Filed: Feb. 21, 1979

[30] Foreign Application Priority Data

Feb. 24, 1978 [JP] Japan ..... 53-19720

[51] Int. Cl.[3] ..... B21D 51/06

[52] U.S. Cl. ..... 113/1 R; 113/120 G; 93/49 R; 93/58 R

[58] Field of Search ..... 113/1 R, 1 N, 1 G, 120 E, 113/120 R, 120 G, 120 K, 120 Y; 72/306, 319; 93/49 R, 58.3, 58 R

[56] References Cited

U.S. PATENT DOCUMENTS

| | | | |
|---|---|---|---|
| 2,401,031 | 5/1946 | Wanasek | 72/319 |
| 2,669,914 | 2/1954 | Swaine | 113/120 G |

*Primary Examiner*—Milton S. Mehr

*Attorney, Agent, or Firm*—George B. Qujevolk

[57] ABSTRACT

A safe box-like structure of good appearance is formed in a simplified manner from a flat metal sheet by folding at right angles the opposite side portions of a flat rectangular metal sheet, for instance, of a steel sheet to provide a channel-shaped metal sheet, forming in each end portion of the upright side sections of the channel-shaped metal sheet a diagonal crease extending from an inner end of a prescribed vertical fold line disposed substantially perpendicular to the bottom section of the bottom section of the channel-shaped metal sheet to the outer corner point of the end portion of the side section, pressing a triangular intermediate section between the prescribed vertical fold line and the diagonal crease inwardly of the channel-shaped metal sheet, folding the triangular intermediate section and an outer triangular section toward each other along the afore-mentioned prescribed vertical fold line and diagonal crease, and upbending opposite end portions of the channel-shaped metal sheet at right angles, putting inside the wedge-shaped portions consisting of overlapped triangular sections which are formed at the joints of the adjacent side and end sections of the box-like structure, thereby precluding the dangers which would be otherwise invited by exposed wedge-shaped portions.

6 Claims, 16 Drawing Figures

METHOD AND APPARATUS FOR MANUFACTURING BOX-SHAPED STRUCTURE FROM METAL SHEET

BACKGROUND OF THE INVENTION

1. Field of the Invention

This invention relates to novel method and apparatus for folding metal sheets into box-like structures which can serve for versatile purposes, for instance, as anti-rust top covers for stacked metal sheets to be packed for transportation.

2. Description of the Prior Art

Thin steel sheets products are usually shipped out from a factory in the form of stacks each containing a large number of sheets of a predetermined size. The stacked steel sheets are wrapped in packing paper and then applied, on all sides, with protection covers, including side-protecting iron plates of inversed L-shaped in section, a top-protecting iron plate and a bottom-protecting iron plate, finally binding them together with packing tapes.

The sheet products which have been packed in this manner are stacked on a deck of a freight ship or sometimes stored in open air when suitable storing facilities are not available. In such a case, there has been a serious problem in that splashes of sea waves or rain water get into the packed products through gap between the top- and side-protecting cover plates, producing rust on the sheet products to deteriorate their quality to a considerable degree.

As a measure to prevent such problem, it has been proposed to cover the top of the stacked sheet products with a box-like structure of metal sheet. The box-like cover is formed, for example, by folding four sides of a rectangular steel sheet at right angles as shown in FIG. 1, to form side sections 1 and sections 2. The doubled triangular wedge-like portions 3 at the joints of the adjacent side and end sections 1 and 2 are then lapped onto the outer surfaces of the side section 1 or end section 2 to form a structure as shown in FIG. 2.

However, a box structure of that type which has the wedge-shaped portions 3 simply lapped onto the outer surfaces of the side sections 1 or end sections 2 has a difficulty in that the pointed ends of the wedge-shaped portions 3 have a tendency of disengaging from the outer surfaces of the side sections or end sections, hurting or scratching worker's hands or other things while may touch them. In addition, the wedge-shaped portions which are exposed on the outer surfaces of the side or end sections impair the appearance of the box-like structure itself.

SUMMARY OF THE INVENTION

The present invention has as its primary object the production of a box-like metal structure which is particularly suitable for use as an anti-rust top cover for stacked sheet products or for other purposes and which can be easily fabricated by folding a single metal sheet.

It is another object of the present invention to produce a box-like metal structure easily by folding a single metal sheet, in which the wedge-shaped portions of the overlapped triangular sections are not exposed to provide an improved appearance.

It is still another object of the present invention to provide a box-like metal structure which does not have the wedge-shaped portion exposed on the outer side thereof to prevent the sharp edges of the wedge-shaped portions from bruising worker's hands or hooking other thing or from being raised by hooking on other things.

It is a further object of the present invention to fold the metal sheet precisely and in a simplified manner along prescribed vertical and diagonal fold lines by providing in each end portion of the upright side sections of the channel-shaped metal sheet a diagonal crease extending from an inner end of a prescribed vertical folding line disposed substantially perpendicular to the bottom section of the channel-shaped metal sheet to the outer corner point of the end portion of the side section, with use of a pressing die and a counter die, pressing a triangular intermediate section between the prescribed vertical fold line and the diagonal crease inwardly of the channel-shaped metal sheet while gripping the side section on the inner side of the prescribed vertical fold line, and folding the intermediate triangular section and an outer triangular section toward each other along the prescribed vertical fold line and the diagonal crease.

The above and other objects, features and advantages of the present invention will become apparent from the following description and the appended claims, taken in conjunction with the accompanying drawings which show by way of example a preferred embodiment of the invention.

DESCRIPTION OF THE PREFERRED EMBODIMENTS

Figure 1:
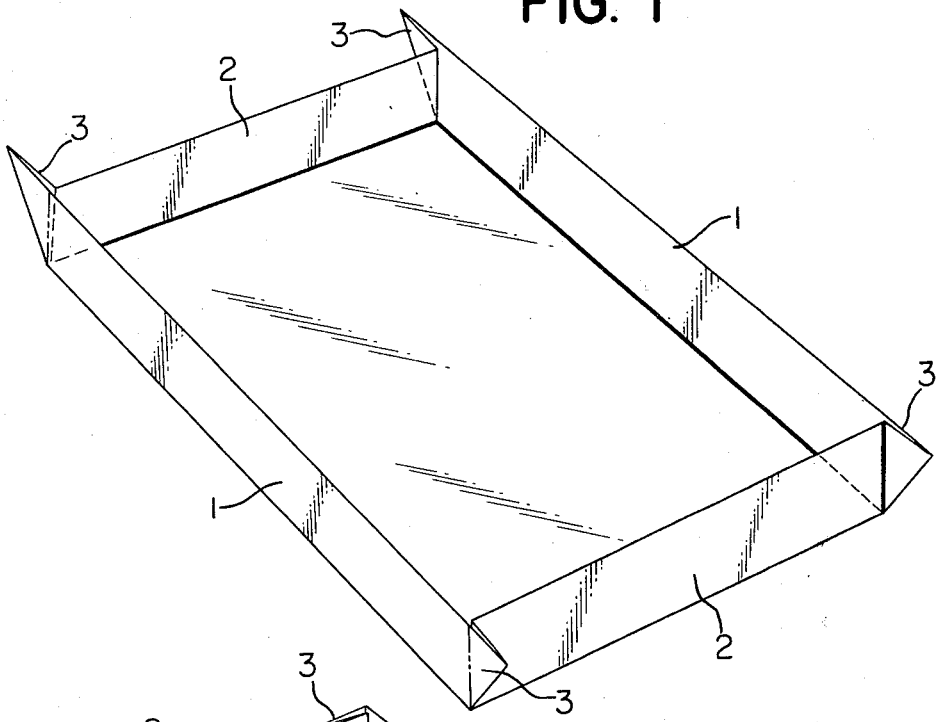
FIGS. 1 and 2 are perspective views illustrative of the conventional method for manufacturing a box-shaped metal structure.
Figure 2:
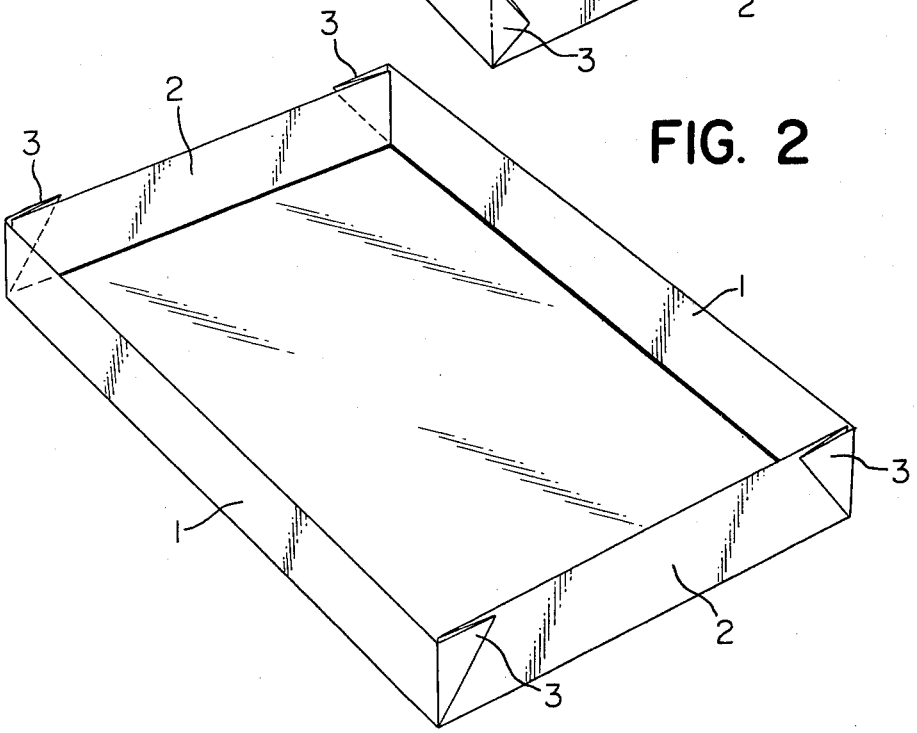
Figure 3:
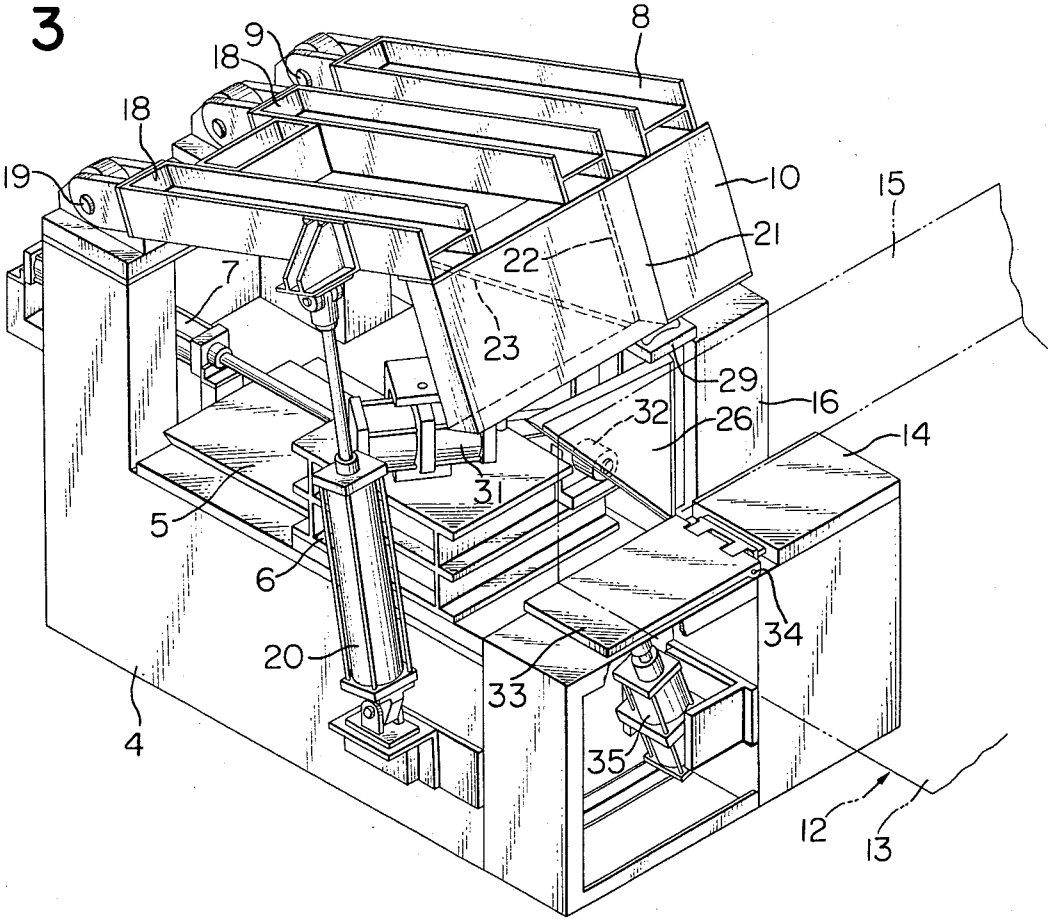
FIG. 3 is a perspective view, partly cut away, of one of corner folders of the apparatus for fabricating the box-shaped metal structure according to the present invention.
Figure 4:
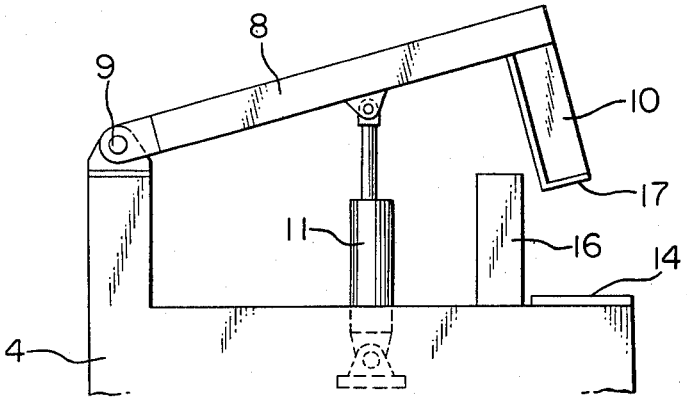
FIG. 4 is a front view of a clamp member of the corner folder.
Figure 5:
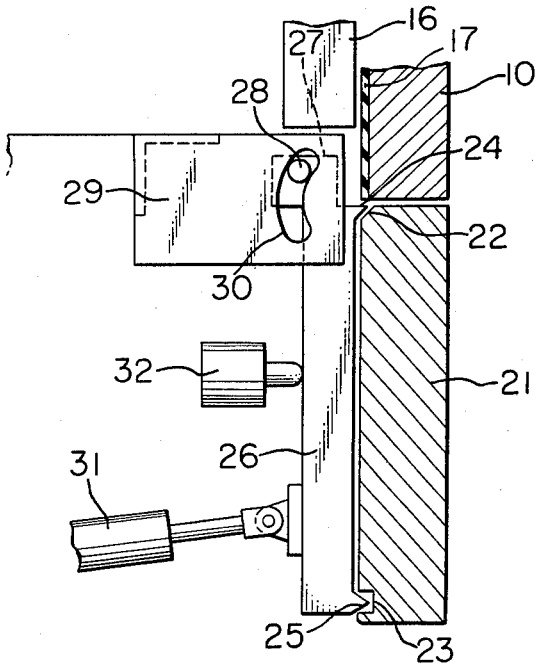
FIG. 5 is a plan view, partly in section, showing relations between a pressing die, a counter die and a side section support member of the corner folder.

Referring to FIGS. 3 to 5, there is shown a corner folder which folds one corner portion of the box-like metal structure, and which includes a main frame 4, a transversely extending guide member 5 of an inversed trapezoidal shape in section, the guide member 5 being fixed on the main frame 1, and a traversing frame 6 slidably fitted on the guide member 5. The traversing frame 6 and main frame 1 are connected with each other through a fluid-operated traversing cylinder 7. Further, an outer end of a clamp arm 8 is rockably mounted on the frame 4 through pivot shafts 9 which extend in the forward and backward directions of the main frame. The inner end of the clamp arm 8 is integrally secured to an upper end of a clamp member 10, the clamp arm 8 having its intermediate portions linked to the main frame 4 through a fluid-operated clamping cylinder 11. The main frame 4 has fixedly mounted thereon a bottom support plate 14 which supports the under side of the bottom section 12 of the metal sheet of channel section and a side support member 16 which supports the outer surface of the side section 15 of the channel-shaped metal sheet 12. The clamp member 10 has integrally secured thereto an anti-slip layer 17 of a rubber sheet which is to be pressed against the upper surfaces of the bottom section 13 and the inner surfaces of the side section 15 of the channel-shaped metal sheet 12. The channel-shaped metal sheet 12 is thus firmly gripped and blocked against backward or forward movements by the clamp member 10 with the rubber layer 17, and the aforementioned bottom support member 14 and side support member 16.

Holding arms 18 which are juxtaposed on the front or rear side of the above-mentioned clamp arm 8 have the respective outer ends rockably mounted on the main frame 4 through pivot shafts 19 which extends in the forward and rearward directions, the holding arm 18 having its intermediate portion linked to the main frame 4 through a fluid-operated elevating cylinder 20. The inner end of the holding arms 18 are integrally secured to the upper end of a counter die 21, the outer surface of which is provided with a groove 22 for forming the vertical crease and with a groove 23 for forming the diagonal crease.

A triangular pressing 26 with a straight crease-forming protuberance 24 matching with the vertical groove 22 and a diagonal crease-forming proturberance 25 matching the diagonal groove 23 has its vertical side fixed to a frame rod 27, the upper and lower ends of which frame rod 27 are fixed to a vertical support shaft 28 which is movably and rotatably fitted in an arcuate slot 30 in a bearing member 29. The just-mentioned bearing member 29 is fixed to the traversing frame 6.

The intermediate portion of the afore-mentioned pressing die 26 is linked to the traversing frame 6 through a rotating fluid-operated cylinder 31. Further, a fluid-operated crease-forming cylinder 32 is fixedly mounted on the traversing frame 6 at a position opposing the intermediate portion of the pressing die 26. On the main frame 4, one end of an upbending member 33 is rockably supported on a transversely extending shaft 34 at a position adjacent to the front or rear side of the bottom section support member 14. The intermediate portion of the upbending member 33 is linked to the frame 4 through a fluid-operated upbending cylinder 35.

Figure 6:
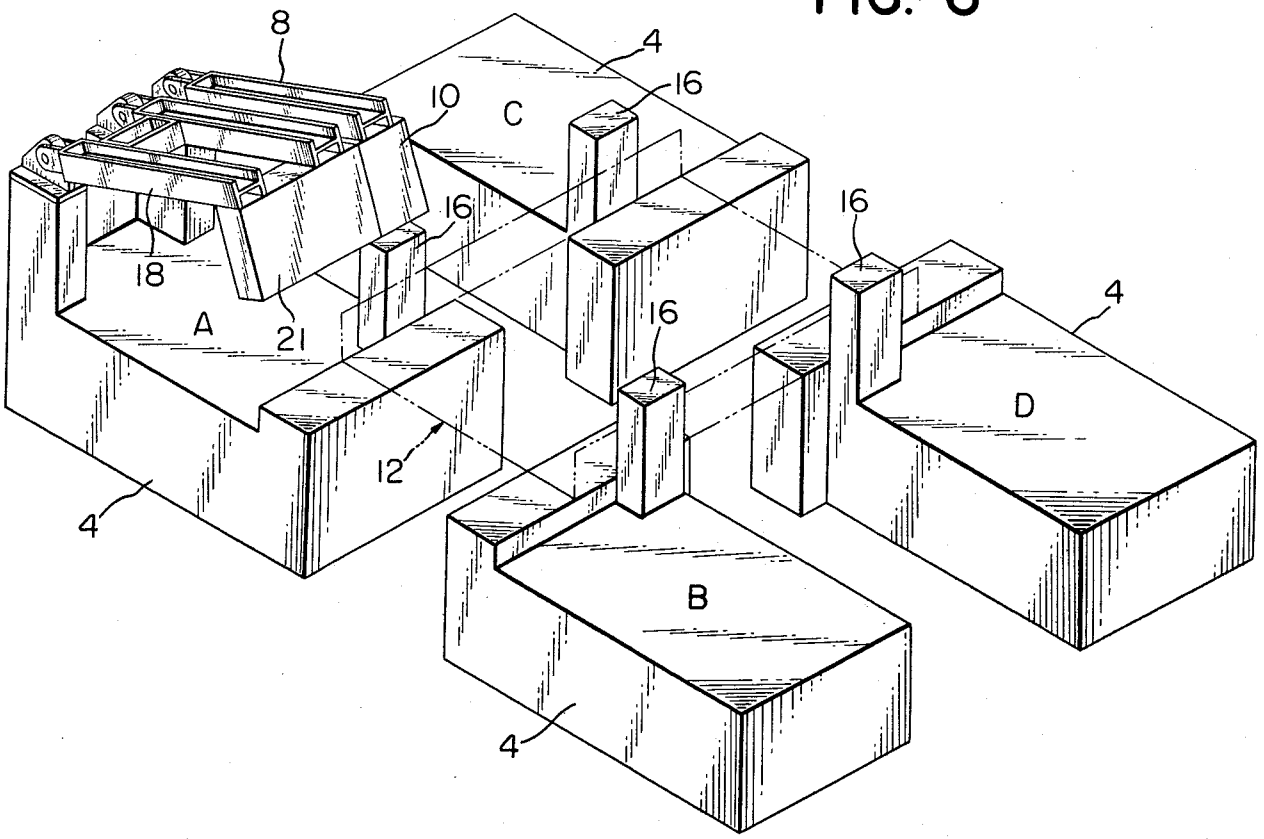
FIG. 6 is a diagrammatic perspective view showing four corner folders in position, some parts of the corner folders being omitting for the simplicity of illustration.

The four corner folds A to D, each construced in the above-described manner, are positioned as shown in FIG. 6, in positions spaced from adjacent ones by a certain distance. The first one of the four corner folders A to D is fixed in a predetermined position, while the other corner folders are slidably placed on a support (not shown). More particularly, the position of the second corner folder B is shiftable widthwise of the channel-shaped metal sheet 1, the position of the third corner folder C is shiftable in the longitudinal direction of the channel-shaped metal sheet 1, and the fourth corner folder D is shiftable both longitudinal and widthwise of the channel-shaped metal sheet 1, by means of a position adjuster (not shown) which is constituted by a screw rod which is rotatingly driven from a motor through a reducer and a female screw member which is meshed with the screw rod. The positions of the respective corner folders A to D are thus adjustable according to the width and length of the box-like structure to be produced.

Figure 7:
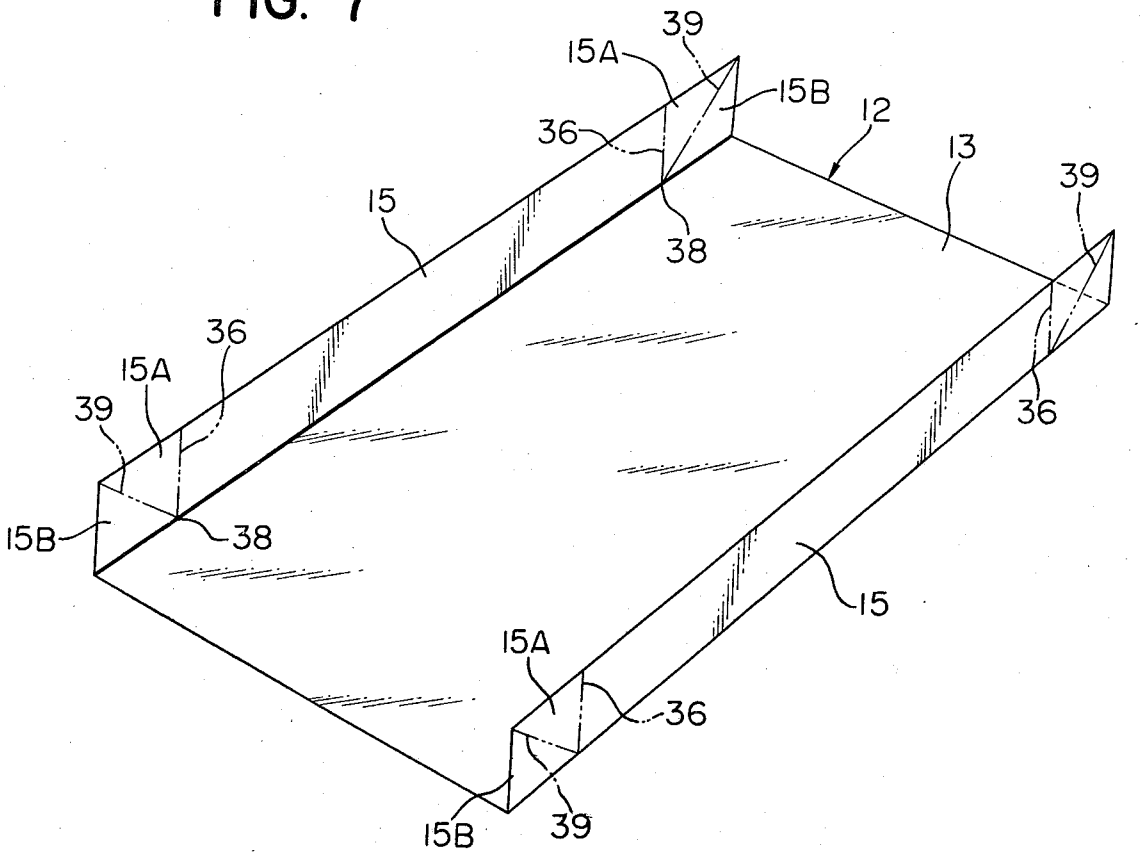
FIG. 7 is a perspective view of a metal sheet which has been folded into a channel shape.

In order to fabricate a box-shaped structure by the use of the corner folders A to D, the opposite sides of a metal sheet, for instance, a steel sheet having a thickness of about 0.27 to 3.2 mm in unfolded state, are first bent at right angles by press or roll forming to provide a channel-shaped metal sheet 12 as shown in FIG. 7. The bottom section of the channel-shaped metal sheet 12 is then placed on the bottom support members 14 of the corner folders A to D, locating the end portions of the bottom sections 13 on the upbending members 33 and the end portions of the side sections 15 on the inner sides of the respective press dies 26.

Figure 8:
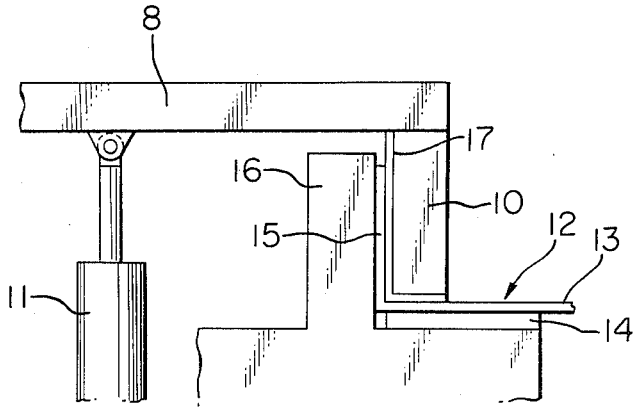
FIG. 8 is a front view of the channel-shaped metal sheet in a clamped state.

Then, the fluid-operated clamping cylinders 11 are actuated to turn down the respective clamp arms 8 to grip the bottom section 13 and the side sections 15 at the four corners of the channel-shaped sheet 12 between the respective bottom support members 14, side support members 16 and clamp members 10 as shown in FIG. 8, while the fluid-operated upturning cylinders 20 are simultaneously actuated to lower the counter dies 21 through the holding arms 18 onto the bottom section 13 of the channel-shaped metal sheet 12, abutting the counter dies 21 against the inner surfaces of the side sections thereof.

Figure 9:
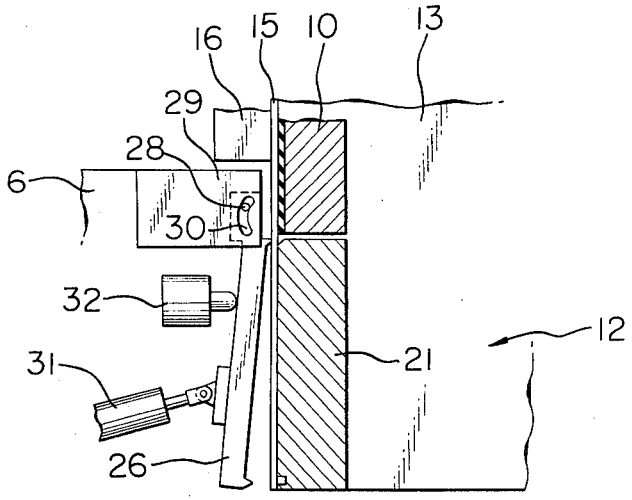
FIG. 9 is a plan view of the corner folder ready for forming a straight and a diagonal crease at one corner of the side section of the metal sheet.
Figure 10:
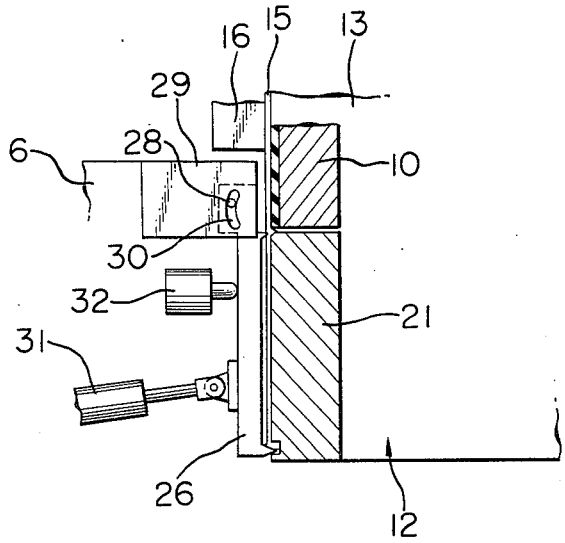
FIG. 10 is a plan view, partly in section, of the corner folder which is in operation for forming the straight and diagonal creases at one corner of the side section of the metal sheet.
Figure 11:
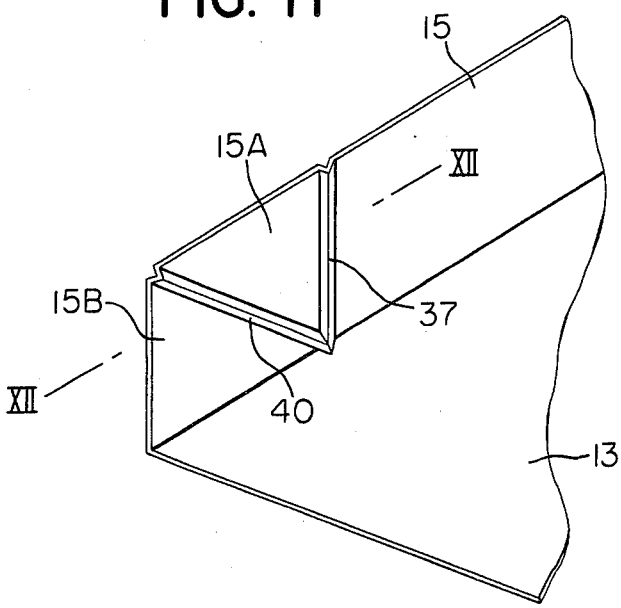
FIG. 11 is a perspective view of one corner of the side section which has been formed with straight and diagonal creases.
Figure 12:
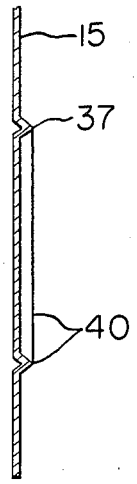
FIG. 12 is a sectional view taken on line XII—XII of FIG. 11.

As shown in FIGS. 9 and 10, the fluid-operated crease-forming cylinders 32 are extending to press the respective dies 26 to form each end portion of the side sections 15 of the channel-shaped sheet 12 a vertical crease 37 of substantially V-shape in section along a prescribed vertical fold line 36 approximately perpendicular to the bottom section 13 and a diagonal crease 40 of substantially V-shape in section along a diagonal fold line 39 which connects the inner end 38 of the prescribed vertical fold line 36 and the outer corner point of the side section 15, thereafter contracting the fuid-operated cylinder 32.

Figure 13:
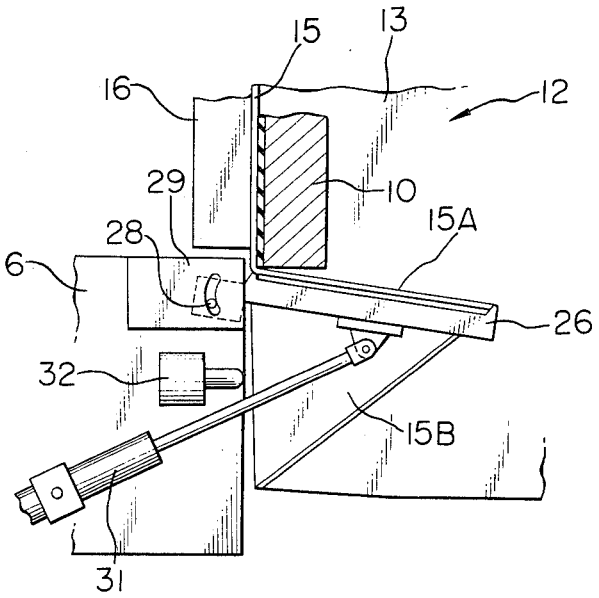
FIG. 13 is a plan view, partly in section, of the corner folder which is in operation for inwardly folding an intermediate triangular section of the creased corner.
Figure 14:
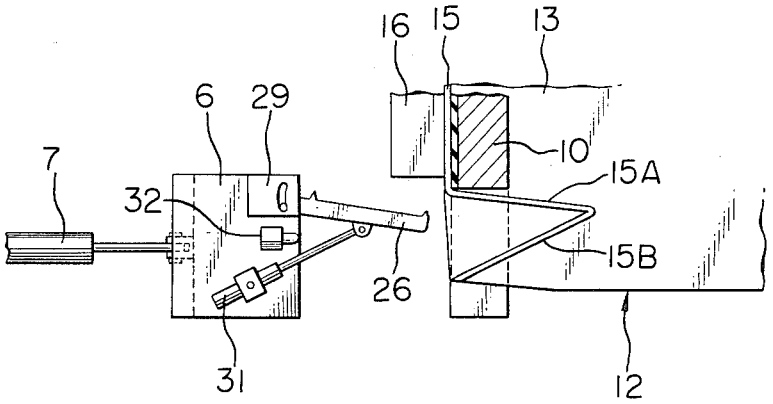
FIG. 14 is a plan view, partly in section, of a transversely movable frame and the component parts supported by the transversely movable frame, moving away from the side section of the metal sheet.

In the next place, the fluid-operated cylinders 31 are actuated to raise the counter dies 21 through the holder arms 18, and the triangular pressing dies 26 are rotated through about 30 to 80 degrees inwardly of the channel-shaped metal sheet 12 by the respective fluid-operated rotating cylinders 31 as shown in FIG. 13, thereby inwardly folding along the crease 37 the intermediate triangular section 15A between the prescribed vertical fold line 36 and the diagonal fold line 39 substantially into an L-shaped and at the same time folding the intermediate triangular section 15A and the outer triangular section 15B of the side section 15 into V-shape along the diagonal crease 40. After this, the fluid-operated traversing cylinder 7 of each corner field is contracted to move outwardly the traversing frame 6 and the fluid-operated rotating cylinder 31, crease forming cylinder 32 and pressing die 26 which are mounted thereon, bringing the pressing die 26 on the outer side of the side section 15 as shown in FIG. 14 and further contracting the fluid-operated rotating cylinder 31.

Figure 15:
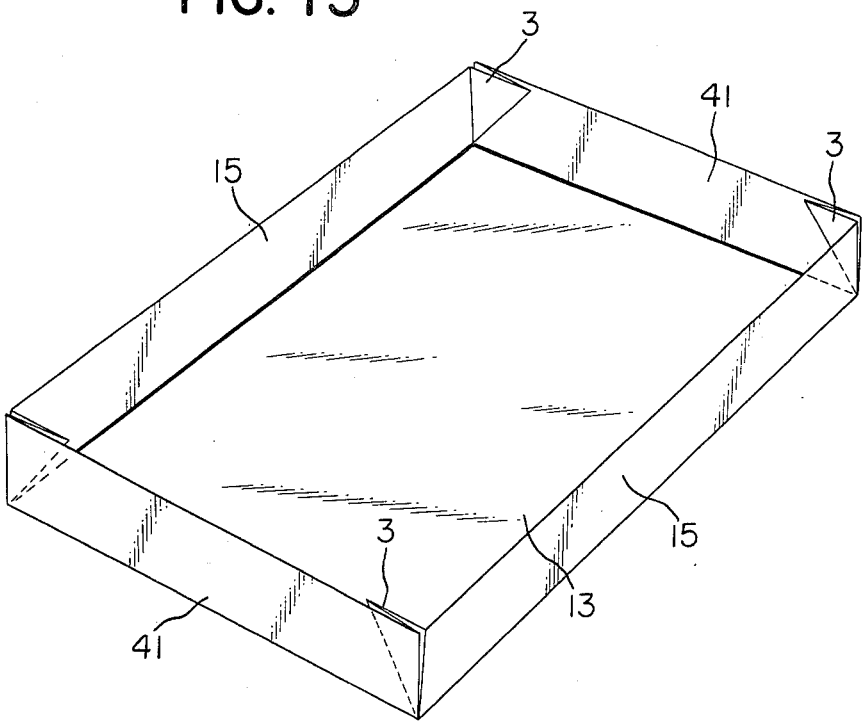
FIG. 15 is a perspective view of a box-like metal structure formed by the method and apparatus according to the present invention.
Figure 16:
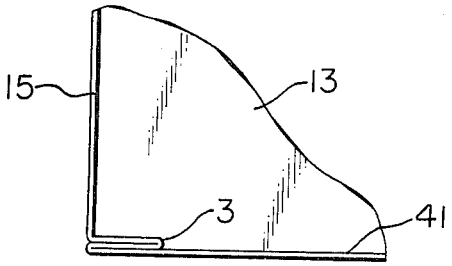
FIG. 16 is an enlarged fragmentary view showing one corner portion of the box-like metal structure of FIG. 15.

The fluid-operated upbending cylinder 35 is then stretched out to raise and rotate the upbending member 33, thereby upbending the opposite end portions of the channel-shaped metal sheet 12 to form upright end sections 41 as shown in FIGS. 15 and 16, lapping on the inner surface of the end section 41 the wedge-shaped portion 3 which consists of overlapped intermediate triangular section 15A and outer triangular section 15B. As soon as this is accomplished, the fluid-operated upbending cylinder 35 is contracted to turn down the upbending member 33.

Nextly, the fluid-operated clamping cylinder 11 is stretched to raise the clamp member 10 and the box-like structure which as been formed by the foregoing operations is sent out of the corner folders A to D, followed by stretching of the fluid-operated traversing cylinder 7 to return the traversing frame 6 to the initial position.

When fabricating the box-like metal structure according to the present invention, the vertical groove 22, the opposing vertical protuberance 24 and thus the vertical crease 37 of the side section 15 may be omitted if desired. In a case where the box-like metal structure is formed from a thin steel plate having a thickness of about 0.27 to 1.2 mm, arrangement may be made to press the die 26 by the fluid-operated cylinder 31 to form the creases 37 and 40, omitting the crease forming cylinder 32. Moreover, a thin metal sheet which can easily undergo elastic deformation at the end portions of the side sections is used, the pressing die 26 can be turned into the initial position from the position of FIG. 13 simply by contracting the fluid-operated cylinder 31 without retracting the traversing frame 6.

Upon setting the channel-shaped metal sheet 12 on the four corner folders A to D, it is preferred to provide a stopper which determines the longitudinal position of the channel-shaped metal sheet 12 by engaging one end portion of the bottom section thereof. The respective one of the above-mentioned fluid-operated cylinders may be either a pneumatic cylinder or a hydraulic cylinder. However, where a steel sheet having a thickness of 1.3 to 3.2 mm is to be folded into the box-like structure, it is preferred to employ a hydraulic cylinder for the afore-mentioned fluid-operated cylinder 32.

What is claimed is:

1. An apparatus for fabricating a box-like metal structure from a channel-shaped metal sheet having a rectangular bottom section and a pair of side sections rising upright from opposite sides of the bottom section, said apparatus comprising:

a main frame;

a bottom support member and a side support member provided on said main frame to support the underside of said bottom section and outer surface of said side section of said channel-shaped metal sheet, respectively;

a clamp arm and a holding arm having the respective outer ends thereof rockably connected to said main frame having a clamp member fixed to the inner end thereof for gripping the bottom and side sections of said channel-shaped metal sheet in cooperation with said bottom and side support members;

a counter die fixedly mounted at the fore end of said holding arm and having a diagonal crease forming groove;

a pressing die mounted in opposing relation with the outer surface of said side section of said channel-shaped metal sheet and having a diagonal crease forming protuberance cooperative with said diagonal crease forming groove of said counter die for forming a diagonal crease in the side-section of said channel-shaped metal sheet; and an upbending member pivotally mounted on said main frame for upwardly bending an end portion of said bottom section of said channel-shaped metal sheet.

2. An apparatus for fabricating a box-like metal structure according to claim 1, wherein said pressing die is constituted by a triangular member having said diagonal crease forming protuberance on the face thereof, the vertical side of said triangular pressing die being rotatably supported on a vertical shaft.

3. An apparatus for fabricating a box-like metal structure according to claim 2, wherein said vertical side of said pressing die is rotatably mounted on a shaft which is disposed vertical to a traversing frame movable toward and away from said side section of said channel-shaped metal sheet.

4. An apparatus for fabricating a box-like metal structure according to claim 1, wherein said counter die is provided with a vertical crease forming groove and said pressing die is provided with a vertical crease forming protuberance opposingly to said vertical groove.

5. An apparatus for fabricating a box-like metal structure according to claim 1, wherein said clamp member is provided with an anti-slip layer on those surface areas which contact the bottom and side sections of said channel-shaped metal sheet.

6. An apparatus for fabricating a box-like metal structure according to claim 1, wherein said clamp arm, holding arm, pressing die and upbending member are adapted to be rotated by a fluid-operated cylinder, and said transversing frame is adapted to be moved by a fluid-operated cylinder.

* * * * *